US006406353B1

(12) United States Patent
Harper

(10) Patent No.: US 6,406,353 B1
(45) Date of Patent: Jun. 18, 2002

(54) ELASTIC UNDER-BREAST AND BETWEEN-BREAST BAND FOR ABSORPTION OF PERSPIRATION

(76) Inventor: Jeana L. Harper, 5071 Rohns, Detroit, MI (US) 48213-3028

( * ) Notice: Subject to any disclaimer, the term of this patent is extended or adjusted under 35 U.S.C. 154(b) by 0 days.

(21) Appl. No.: 09/934,017

(22) Filed: Aug. 21, 2001

(51) Int. Cl.[7] ..... A41C 3/00
(52) U.S. Cl. ..... 450/57; 450/1; 2/53
(58) Field of Search ..... 450/57, 60, 53, 450/81, 80, 56, 1; 128/888–894; 2/267, 73, 46, 463, 455, 53, 56, 57, 1, 311–312, 338

(56) References Cited

U.S. PATENT DOCUMENTS 2,418,197 A * 4/1947 Sherer ..... 2/46
2,621,328 A 12/1952 Duchnofskey
4,449,252 A * 5/1984 Sullinger ..... 2/46
5,245,707 A * 9/1993 Green ..... 2/54
5,603,653 A 2/1997 Hartman
5,664,984 A 9/1997 Laughridge
5,716,255 A 2/1998 Abercrombie et al.
5,807,160 A * 9/1998 Wehmeyer ..... 450/57
5,858,014 A 1/1999 Kepes et al.
5,964,641 A 10/1999 Laughridge
5,980,359 A 11/1999 Brown
6,095,893 A 8/2000 Lin
6,095,894 A * 8/2000 Stevens ..... 450/57
6,110,006 A 8/2000 Chen
6,203,399 B1 3/2001 Hackney
6,203,810 B1 3/2001 Alemany et al.

* cited by examiner

*Primary Examiner*—Gloria M. Hale
(74) *Attorney, Agent, or Firm*—Brooks & Kushman P.C.

(57) ABSTRACT

An under-breast absorption garment for absorbing perspiration from under the breasts of a torso, the garment comprising a band for maintaining the under-breast absorption garment in the proper position on the torso; and absorbent material co-operable with the band so that the absorbent material is positioned under the breasts.

22 Claims, 3 Drawing Sheets

ELASTIC UNDER-BREAST AND BETWEEN-BREAST BAND FOR ABSORPTION OF PERSPIRATION

BACKGROUND OF THE INVENTION

1. Field of the Invention

The present invention relates to an under-breast and between-breast absorbent torso band.

2. Background Art

The use of an absorbent device is known in the prior art. Historically, women have gone through great lengths to remove or at least reduce the wetness and odor caused by perspiration. The excretion of perspiration occurs at all times of the day and night. However, during an active day the amount of moisture excreted increases significantly, especially in humid and extremely warm climates or environments. This is also the case in exercise and sports situations. A considerable amount of water loss from perspiration occurs in the upper body area around the torso and between the breasts.

To combat the adverse effects of perspiration, women have resorted to a myriad of methods. Some of these methods have been to use napkins, paper towels, toilet paper, or tissues to absorb perspiration under and between breasts. Powder, deodorant and perfume have also been used to help control the odor that is produced due to the moisture. The results of both of these methods are temporary and inconvenient. Tissue and the like fold and crumple and could potentially cause embarrassment by slipping out from under the brassiere and falling out into public view. Powders flake and cake and after becoming moist and may filter through the clothing item being worn leaving a noticeably wet spot. Perfumes mixed with the odor of perspiration produce an unfavorable smell.

Women are in need of methods by which moisture under and between the breasts can be absorbed and the area can be deodorized if desired. This moisture is due to various reasons which include but are not limited to anxious perspiration, hot flashes, large breasts, bust increase due to pregnancy, physical exercise, extremely warm temperatures, and women who are overweight, obese or very busy, active women.

Previous patents such as U.S. Pat. Nos. 5,664,984; 5,964,641; and 5,716,255 have all suggested the use of a liner made of moisture absorbent material attached to the brassiere or an area on the frontal portion of the brassiere that absorbs perspiration and can be disposable. U.S. Pat. No. 5,980,359, entitled Bra Barrier Device, discloses an absorption device that is specifically worn with a brassiere. This device prevents dermal irritation and lesions caused by heat, moisture and chafing associated with use of the bra. Finally, U.S. Pat. No. 6,203,399, entitled Absorbent Pad for Torso Area Beneath Breasts, discloses a device that is utilized by aligning the pad between the cups of the bra by a notch extending from the medial portion of the top edge of pad. All of the aforementioned patents require the use of a bra.

SUMMARY OF THE INVENTION

Accordingly, an object of the invention is to provide an under-breast absorption garment for absorbing perspiration from under the breasts of a torso.

The garment comprises a band for maintaining the under-breast absorption garment in the proper position on the torso and absorbent material co-operable with the band so that the absorbent material is positioned under the breasts.

In one embodiment of the invention, the garment comprises an absorbent elasticized band with a frontal area made of washable terrycloth or a disposable material to absorb perspiration under and between the breasts and to reduce and/or eliminate the odor, rashes and general discomfort. This torso band is easily hidden under the bra and is positioned directly underneath the breast area. The elastic band extends around the torso and under the bra for a comfortable and attractive fit. The primary attraction of the present invention is the independent nature of the band. A bra is not required in order to use the present invention. The band can be worn with or without a bra. On humid and/or hot days, the band can be worn while relaxing or even sleeping. The elastic portion of the band can also be adjusted by a plastic clip to accommodate the wearer's size.

In another embodiment, the present invention further comprises an absorbent member that extends upwardly from the band or absorbent material, and the absorbent material is configured to extend between the breasts. The absorbent member may be detachable or permanently attached to the band or absorbent material. The absorbent member may be made of the same material as the absorbent material.

In the aforementioned patents, usage dealt with fitting the absorbent material to the brassiere. It is common for women with large and extremely large breasts to not be able to find reasonably priced bras that cover the entire area of the breasts, which expose skin from the breast and cause that skin to lie on top of the torso, which causes added irritation and moisture. Therefore, the prior inventions may not fit correctly underneath the breasts since it relies on a properly fitting bra.

The above objects, purposes, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
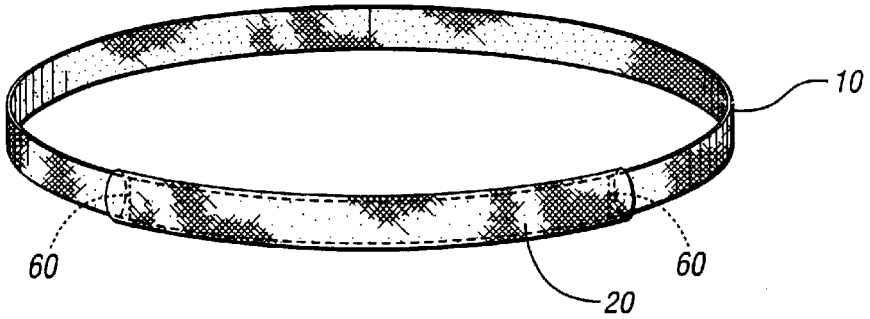
FIG. 1 is a perspective view of the under-breast absorption garment of the present invention having a unitary construction.
Figure 2:
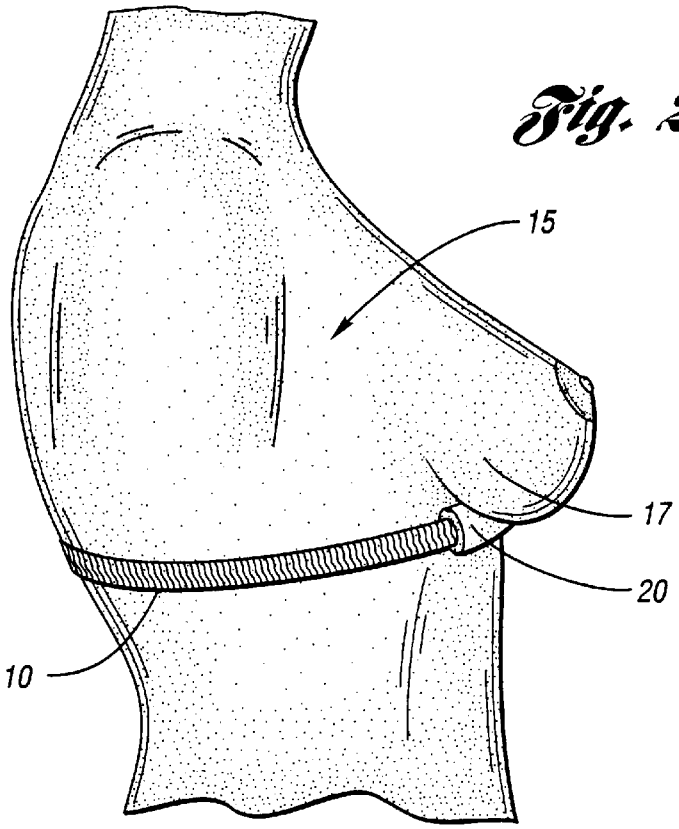
FIG. 2 is a side view of the under-breast absorption garment of the present invention worn by a female.

Referring now to FIGS. 1 and 2, the under-breast absorption garment 1 of the present invention is shown both unworn and worn by a female. Of course, the under-breast absorbent garment 1 may also be worn by males if needed. The under-breast absorption garment 1 is comprised of band 10 and absorbent material 20. Band 10 maintains the under-breast absorption garment in proper position on the torso 15 of the wearer, i.e., so that the absorbent material 20 is positioned under the breasts 17 to absorb perspiration.

Figure 3:
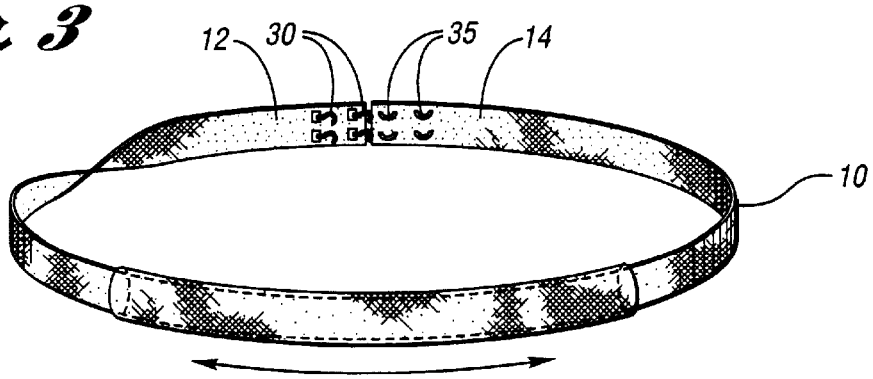
FIG. 3 is a perspective view of the under-breast absorption garment of the present invention showing an alternate attachment method.
Figure 4:
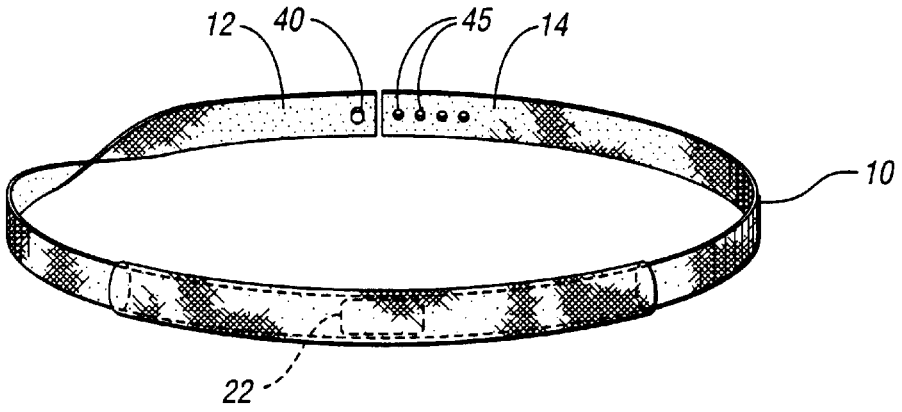
FIG. 4 is a perspective view of the under-breast absorption garment of the present invention.
Figure 5:
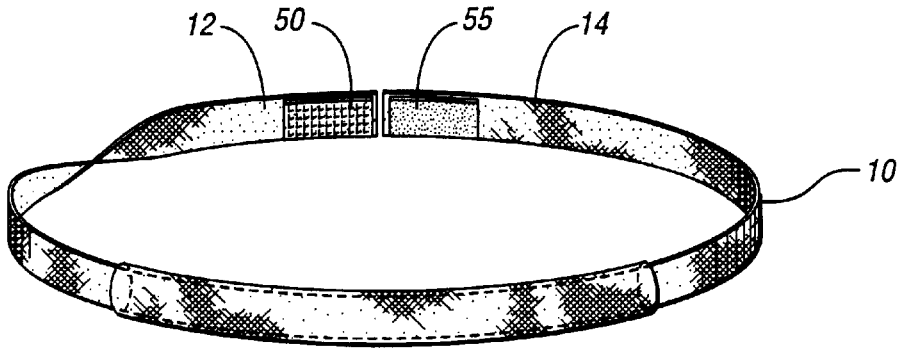
FIG. 5 is a perspective view of the under-breast absorption garment of the present invention.
Figure 6:
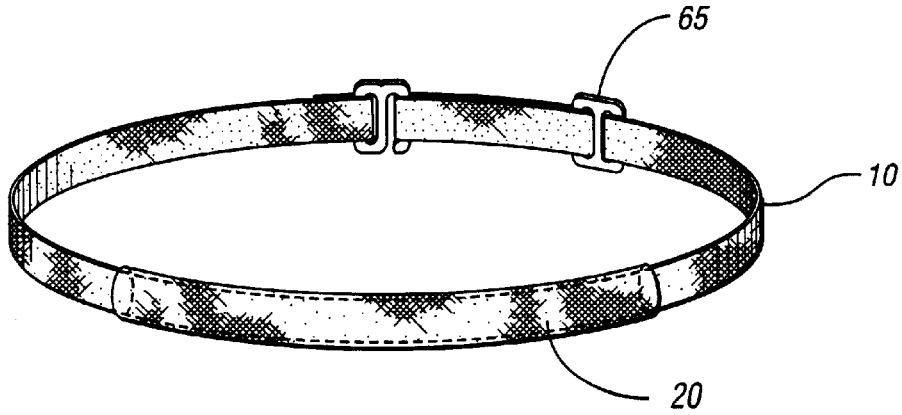
FIG. 6 is a perspective view of the under-breast absorption garment of the present invention showing an alternate attachment method.

Band 10 may be made out of any material such as rubber, nylon, denim, canvas, silk, elastic, cotton, and terry cloth. Preferably, the material will be machine washable so that it can be washed and reused. Band 10 may be either a single integrally connected piece of material, as shown in FIGS. 1 and 2, or may be a piece of material having two ends 12 and 14 that need to be attached as shown in FIGS. 3, 4, and 5. To properly fit a wearer, the band may be (1) fitted to the size of the torso (as shown in FIG. 1); (2) elastic to stretch and cinch around the wearer (as shown in FIG. 2); (3) adjustable using a hook 30 and catch 35 as used in most brassieres (shown in FIG. 3), hook and loop-type fasteners 50 55 (as shown in FIG. 5), snap buttons 40 and snap button holes 45 located at appropriate locations along the band (as shown in FIG. 4), or by sliding adjustable clip 65 such as those provided on most current brassieres straps (as shown in FIG. 6); or (4) a combination of the described methods. The means of fastening ends 12 and 14 are not limited to the means identified in this application as one skilled in the art can devise multiple ways of attaching two ends of material together.

Preferably, the band 10 is made out of elastic and adjusted to the proper size using the adjustable plastic clip 65 as shown in FIG. 6.

The absorbent material 20 may be made from any absorbent material such as terry cloth, sponge, cotton, or other known absorbent materials. Preferably, absorbent material 20 is washable so that it can be reused. However, the material may be disposable. The absorbent material 20 may also be sold separately so that it may be replaced on the band when it becomes soiled. Additionally, the absorbent material may contain talc or perfumed talc. The preferred embodiment utilizes terry cloth as the absorbent material.

The absorbent material 20 may be permanently or temporarily attached to band 10. For example, the absorbent material 20 may be sewn to the band using thread 60 as shown in FIG. 1. Absorbent material 20 may also be attached to band 10 using attachment means 22 (as shown in FIG. 4) which may be any other known methods including, but limited to, hook and loop-type fasteners, adhesive, and snaps. Additionally, the absorbent material 20 may be simply wrapped around band 10 like a sleeve and allowed to move transversely along the length on the band 10 as shown in FIG. 3.

Figure 7:
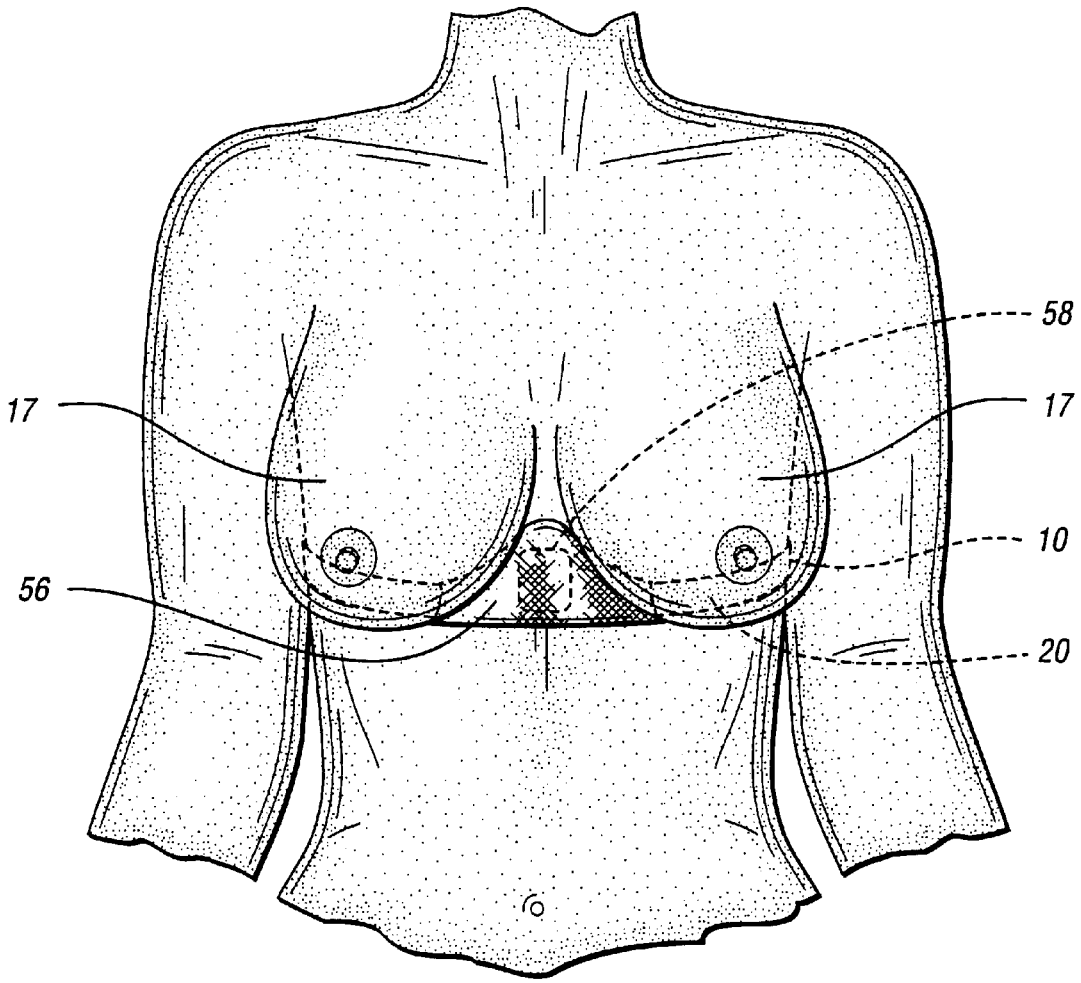
FIG. 7 is a second embodiment of the under-breast absorption garment also having a between-breast absorption member.

Additionally, as shown in FIG. 7, the under-breast absorption garment 1 may also include an absorbent member 56 that extends upwardly between the breasts 17. The absorbent member 56 can be manufactured out of any material that can be used to make the absorbent material 20. Preferably, the absorbent member 56 is manufactured from terry cloth or terry cloth over a sponge form. Absorbent member 56 can be either fixedly or removably attached directly to the band 10 or to absorbent material 20 using attachment 58 which may be any known methods such as by sewing, velcro, snap buttons, or other known methods.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An under-breast absorption garment for absorbing perspiration from under the breasts of a torso, the garment comprising:

an independent band for maintaining the under-breast absorption garment under the breasts of the torso, the band completely encircling the torso; and absorbent material co-operable with the band so that the absorbent material is positionable between the breasts and the torso.

2. The under-breast absorption garment of claim 1 wherein the band is fitted to the size of the torso.

3. The under-breast absorption garment of claim 1 wherein the band is elastic.

4. The under-breast absorption garment of claim 1 wherein the band is adjustable.

5. The under-breast absorption garment of claim 1 wherein the band has first and second ends that are fastenable together using hook and loop fasteners.

6. The under-breast absorption garment of claim 1 wherein the absorbent material is slidable along the band.

7. The under-breast absorption garment of claim 1 wherein the absorbent material is attached to the band using snap buttons.

8. The under-breast absorption garment of claim 1 wherein the absorbent material is formed as a sleeve around the band.

9. The under-breast absorption garment of claim 1 wherein the absorbent material is fixedly attached to the band.

10. The under-breast absorption garment of claim 6 wherein the absorbent material is sewn to the band.

11. The under-breast absorption garment of claim 1 wherein the absorbent material is machine washable.

12. The under-breast absorption garment of claim 1 wherein the absorbent material is disposable.

13. The under-breast absorption garment of claim 1 wherein the absorbent material is replaceable.

14. The under-breast absorption garment of claim 1 further comprising an absorbent member attached that is adapted to extend upwardly between the breasts.

15. The under-breast absorption garment of claim 14 wherein the absorbent member is attached to the absorbent material.

16. The under-breast absorption garment of claim 14 wherein the absorbent member is attached to the band.

17. The under-breast absorption garment of claim 14 wherein the absorbent member is fixedly attached to one of the band or the absorbent material.

18. The under-breast absorption garment of claim 14 wherein the absorbent member is removably attached to one of the band or absorbent material.

19. The under-breast perspiration garment of claim 18 wherein the absorbent member is attached using hook and loop-type fastener.

20. The under-breast perspiration garment of claim 18 wherein the absorbent member is attached using snap buttons.

21. An under-breast absorption garment for absorbing perspiration from under the breasts of a human torso comprising:

an independent strip of elastic material for maintaining the under-breast absorption garment under the breasts of the torso, the strip completely encircling the torso; and absorbent material attached to the strip and positionable between the breasts and the torso.

22. The under-breast absorption garment of claim 21 further comprising an elongated absorbent member attached to one of the strip or absorbent material and adapted to extend upwardly between the breasts.

* * * * *